US009914122B2

(12) United States Patent
Wallin et al.

(10) Patent No.: US 9,914,122 B2
(45) Date of Patent: Mar. 13, 2018

(54) SAMPLE VIAL FOR CALORIMETRIC MEASUREMENTS

(71) Applicant: SYMCEL SVERIGE AB, Kista (SE)

(72) Inventors: Christer Wallin, Spånga (SE); Magnus Jansson, Bromma (SE)

(73) Assignee: SYMCEL SVERIGE AB, Kista (SE)

( * ) Notice: Subject to any disclaimer, the term of this patent is extended or adjusted under 35 U.S.C. 154(b) by 0 days.

(21) Appl. No.: 15/021,645

(22) PCT Filed: Aug. 20, 2014

(86) PCT No.: PCT/SE2014/050950
§ 371 (c)(1),
(2) Date: Mar. 11, 2016

(87) PCT Pub. No.: WO2015/047155
PCT Pub. Date: Apr. 2, 2015

(65) Prior Publication Data

US 2016/0228871 A1 Aug. 11, 2016

(30) Foreign Application Priority Data

Sep. 30, 2013 (SE) ..... 1351135

(51) Int. Cl.

| | |
|---|---|
| ***B01L 3/14*** | (2006.01) |
| ***B01L 3/00*** | (2006.01) |
| ***B65D 8/00*** | (2006.01) |
| ***B65D 1/09*** | (2006.01) |
| ***B65D 41/04*** | (2006.01) |

(52) U.S. Cl.
CPC ..... *B01L 3/50825* (2013.01); *B65D 1/09* (2013.01); *B65D 11/02* (2013.01); *B65D 41/0442* (2013.01); *B01L 2200/02* (2013.01); *B01L 2200/0689* (2013.01); *B01L 2300/042* (2013.01); *B01L 2300/0835* (2013.01); *B01L 2300/16* (2013.01)

(58) Field of Classification Search
CPC ..... B01L 3/5082; B01L 3/50825
USPC ..... 422/550, 549
See application file for complete search history.

(56) References Cited

U.S. PATENT DOCUMENTS 6,410,125 B1 * 6/2002 Brenner ..... C23C 8/24 427/457
2008/0072690 A1 * 3/2008 Kacian ..... B01L 3/50825 73/864.01
2014/0301916 A1 10/2014 Ohga et al.

FOREIGN PATENT DOCUMENTS

WO WO 2013/099647 A1 7/2013

* cited by examiner

*Primary Examiner* — Natalia Levkovich
(74) *Attorney, Agent, or Firm* — Birch, Stewart, Kolasch & Birch, LLP

(57) ABSTRACT

A sample ampoule for calorimetric measurements includes a vial, a lid and a sealing member. The vial, lid and sealing member are adapted to form a hermetically sealed sample ampoule. The vial has a first contact surface and the lid has a second contact surface, the first and second contact surfaces are in contact with each other in a sealed position of the ampoule, and the vial and lid are formed out of materials with different strength.

19 Claims, 1 Drawing Sheet

SAMPLE VIAL FOR CALORIMETRIC MEASUREMENTS

FIELD OF INVENTION

The present invention relates to a sample ampoule for calorimetric measurements comprising a vial, a lid and a sealing member, where the vial, lid and sealing member are adapted to form a hermetically sealed sample ampoule.

DESCRIPTION OF BACKGROUND ART

Using hermetically sealed sample ampoules is a prerequisite for correct measurement of thermal flow in isothermal calorimetry. Any leakage of gas and/or vapor will decrease the accuracy of the measurement.

Sealing of sample ampoules typically involves some combination of a gasket or O-ring seal with a tightening solution e.g. threaded lid or cap.

SUMMARY OF THE PRESENT INVENTION

Problems

The prerequisite of sample ampoule absolute air and moisture tightness demands a closing mechanism with high precision able to withstand multiple opening and closing cycles with retained sealing properties and high reproducibility.

A normal solution for isothermal calorimetry includes O-ring seal and some locking device e.g. threaded cap. Tightening of the cap leads to compression of the O-ring and buildup of stored energy. The stored energy is subsequently released and interferes with measurement accuracy. Energy buildup and release must be controlled to achieve measurement reproducibility.

Also wear on the threads introduced by friction can affect the stability and accuracy of the measurement.

Solution

With the purpose of solving one or more of the above mentioned problems, and from the standpoint of a sample ampoule for calorimetric measurements comprising a vial, a lid and a sealing member, where the vial, lid and sealing member are adapted to form a hermetically sealed sample ampoule, the present invention teaches that the vial has a first contact surface and the lid has a second contact surface, where the first and second contact surfaces are in contact with each other in a sealed position of the ampoule. With the purpose of reducing the friction between the first and second contact surface, and thus reducing wear of the surfaces and the buildup of energy while closing the ampoule, it is proposed that the vial and lid are formed out of materials with different tensile strength.

Also for the reason of reducing friction between the first and second surfaces it is proposed that the first or second contact surface is coated with a low friction surface coating.

In the selection of materials with different strength it is proposed that the lid material is a high tensile material with strength exceeding the vial material, in which case the first contact surface may be coated with a low friction surface coating.

However, it is also possible that the vial material is a high tensile material with strength exceeding the lid material, in which case the second contact surface may be coated with a low friction surface coating.

It is proposed that the low friction surface coating can be made out of titanium nitride, which for instance could be the BALINIT® A of Oerlicon Balzers.

It is also proposed that the sealing member can be a gasket or an O-ring.

With an embodiment where the first contact surface and the second contact surface are threaded to form a closing mechanism and locking device when interacting with each other, it is proposed that the ampoule is adapted to an interaction with a means for applying a fixed torque to the lid when screwed to the vial.

Advantages

The advantages of an inventive sample ampoule are that the friction of the thread will be reduced as well as the long-term wear of the thread will decrease due to the selection of materials with different strength and the coating.

The adaptation to a use of a controlled torque release for tightening of the lid on the sample vial will provide a fixed and reproducible torque for the tightening which will increase in reproducibility of the measurements of the samples.

The fixed and reproducible torque for the tightening of the lid in combination with the reduced friction between the lid and the vial will also result in that more and a consistent amount of the energy applied will be transferred to the sealing member compacting and not be lost in the friction in the thread thus increasing reproducibility of the force applied to the sealing member.

BRIEF DESCRIPTION OF THE DRAWINGS

A sample ampoule according to the present invention will now be described in detail with reference to the accompanying drawings, in which.

DESCRIPTION OF EMBODIMENTS AS PRESENTLY PREFERRED

Figure 1:
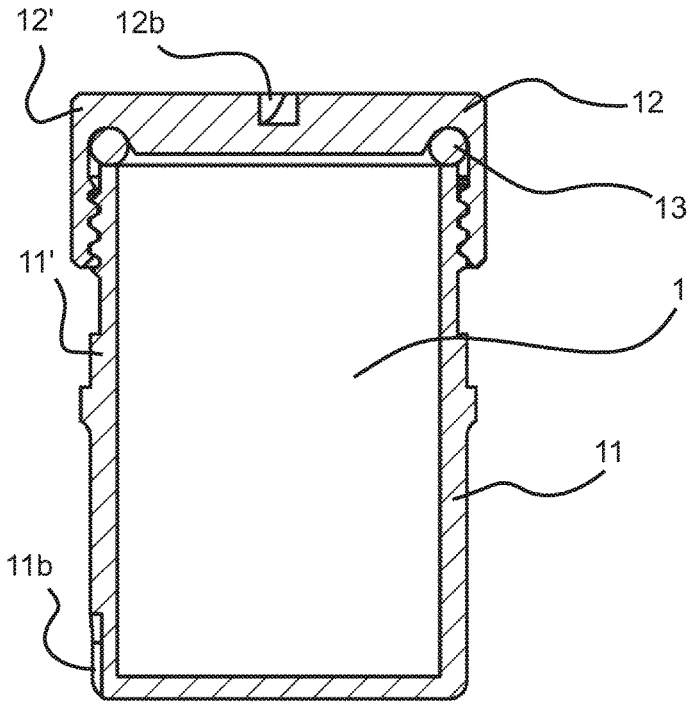
FIG. 1 is a cross sectional view of an inventive ampoule with a vial and a lid.

The present invention will now be described with reference to FIG. 1 showing a sample ampoule 1 for calorimetric measurements comprising a vial 11, a lid 12 and a sealing member 13, where the vial 11, lid 12 and sealing member 13 are adapted to form a hermetically sealed sample ampoule 1.

Figure 2:
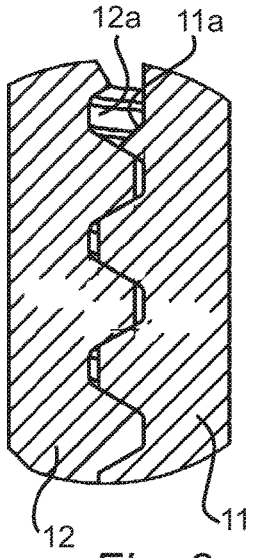
FIG. 2 is an enlarged part of FIG. 1, showing contact surfaces of a vial and a lid.

FIG. 2, being an enlargement of part of FIG. 1, shows that the vial 11 has a first contact surface 11*a* and the lid 12 has a second contact surface 12*a*, where the first and second contact surfaces 11*a*, 12*a* are in contact with each other in a sealed position of the ampoule.

The invention teaches that the vial 11 and lid 12 are formed out of materials 11', 12' with different tensile strength.

It is proposed that the first or second contact surface 11*a*, 12*a* is coated with a low friction surface coating (not shown).

According to one proposed embodiment the lid material 12' is a high tensile material with strength exceeding the vial material 11', in which case it is proposed that the first contact surface 11*a* may be coated with a low friction surface coating.

It is also possible that the vial material 11' is a high tensile material with strength exceeding the lid material 12', in which case the second contact surface 12*a* may be coated with a low friction surface coating.

One proposed embodiment teaches that the low friction surface coating is made out of titanium nitride, such as be the BALINIT® A of Oerlicon Balzers.

The sealing member 13 can be a gasket or, as indicated in FIG. 1, an O-ring.

A closing mechanism and a locking device can be formed in different ways, and one proposed way, as shown in the figures, is that the first contact surface 11*a* and the second contact surface 12*a* are threaded thereby enabling the closing and locking of the ampoule 1 when interacting with each other.

Figure 3:
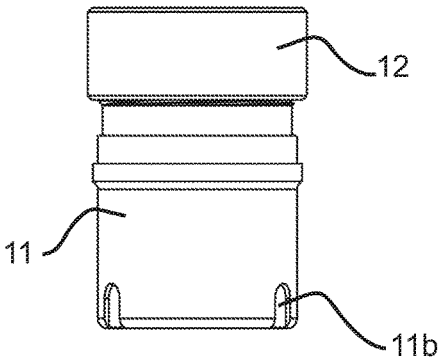
FIG. 3 is a side view of an inventive ampoule with a vial and a lid.
Figure 4:
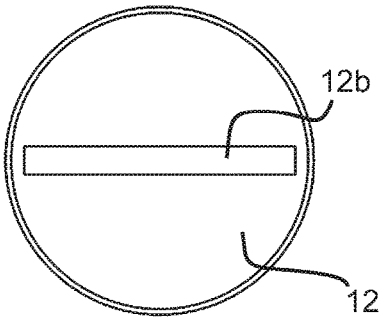
FIG. 4 is a top view of a lid.

It is proposed that the ampoule 1 is adapted to an interaction with a means for applying a fixed torque to the lid 12 when screwed to the vial 11. This can be done in many different ways, FIGS. 1 and 3 shows an example where the vial 11 has a notch 11*b* which will grip into a holder to keep the vial 11 still while applying the lid 12. FIGS. 1 and 4 shows that the lid 12 has a recess 12*b* to which a means for applying a fixed torque can grip the lid 12, which will enable the use of a controlled torque release for tightening of the lid 12 on the vial 11.

It will be understood that the invention is not restricted to the aforedescribed and illustrated exemplifying embodiments thereof and that modifications can be made within the scope of the invention as defined by the accompanying Claims.

The invention claimed is:

1. A sample ampoule, comprising:

a vial;

a lid; and a sealing member, wherein when in a sealed position, the vial, lid and sealing member form a hermetically sealed sample ampoule for isothermal calorimetric measurements that prohibits leakage of gas and/or vapor from within the vial, wherein the vial has a first contact surface and the lid has a second contact surface, wherein the first and second contact surfaces are in contact with each other and the sealing member is located between the vial and the lid in the sealed position of the ampoule, wherein the first contact surface and the second contact surface are threaded to form a closing mechanism and locking device when interacting with each other, wherein the lid is provided with a recess at a top surface extending substantially the entire diameter of the lid and configured to receive a mechanism with a corresponding shape for applying a fixed torque to the lid when screwed to the vial, and wherein the vial has circumferentially spaced notches and wherein the notches are configured to contact a holder to fix the vial in place while threading the lid onto the vial.

2. The sample ampoule according to claim 1, wherein the first or second contact surface is coated with a low friction surface coating.

3. The sample ampoule according to claim 1, wherein the lid material is a high tensile material with a strength exceeding the strength of the vial material.

4. The sample ampoule according to claim 3, wherein the first contact surface is coated with a low friction surface coating.

5. The sample ampoule according to claim 1, wherein the vial material is a high tensile material with strength exceeding the lid material.

6. The sample ampoule according to claim 5, wherein the second contact surface is coated with a low friction surface coating.

7. The sample ampoule according to claim 2, wherein the low friction surface coating is made out of titanium nitride.

8. The sample ampoule according to claim 1, wherein the sealing member is a gasket.

9. The sample ampoule according to claim 1, wherein the sealing member is an O-ring.

10. The sample ampoule according to claim 2, wherein the lid material is a high tensile material with a strength exceeding the strength of the vial material.

11. The sample ampoule according to claim 2, wherein the vial material is a high tensile material with a strength exceeding the strength of the lid material.

12. The sample ampoule according to claim 4, wherein the low friction surface coating is made out of titanium nitride.

13. The sample ampoule according to claim 6 wherein the low friction surface coating is made out of titanium nitride.

14. The sample ampoule according to claim 2, wherein the sealing member is a gasket.

15. The sample ampoule according to claim 3, wherein the sealing member is a gasket.

16. The sample ampoule according to claim 4, wherein the sealing member is a gasket.

17. The sample ampoule according to claim 5, wherein the sealing member is a gasket.

18. The sample ampoule according to claim 6, wherein the sealing member is a gasket.

19. The sample ampoule according to claim 1, wherein the vial and lid are formed out of different materials having different tensile strengths.

* * * * *